US007832453B2

(12) United States Patent
Lin

(10) Patent No.: US 7,832,453 B2
(45) Date of Patent: Nov. 16, 2010

(54) ADJUSTING STRUCTURE OF A CURTAIN FOR ADJUSTING THE ANGLE OF CURTAIN BLADE

(76) Inventor: Ke-Min Lin, No. 18, Fu Chuan Li, Tai Shan 2$^{nd}$ St., Chiayi City (TW)

( * ) Notice: Subject to any disclaimer, the term of this patent is extended or adjusted under 35 U.S.C. 154(b) by 242 days.

(21) Appl. No.: 11/463,503

(22) Filed: Aug. 9, 2006

(65) Prior Publication Data

US 2008/0035280 A1 Feb. 14, 2008

(51) Int. Cl.
*E06B 9/308* (2006.01)

(52) U.S. Cl. ..... 160/168.1 R; 160/176.1 R; 160/170

(58) Field of Classification Search ..... 160/176.1 R, 160/177 R, 168.1 R, 170, 171
See application file for complete search history.

(56) References Cited

U.S. PATENT DOCUMENTS 3,809,143 A * 5/1974 Ipekgil ..... 160/168.1 P
4,377,194 A * 3/1983 Tsuhako ..... 160/168.1 R
4,494,593 A * 1/1985 Fielder, Jr. ..... 160/177 R
5,228,491 A * 7/1993 Rude et al. ..... 160/171
5,611,381 A * 3/1997 Jelic ..... 160/107
5,628,356 A * 5/1997 Marocco ..... 160/170
6,070,638 A * 6/2000 Jelic ..... 160/107
6,105,652 A * 8/2000 Judkins ..... 160/115
6,116,323 A * 9/2000 Huang ..... 160/170
6,394,170 B1 * 5/2002 Hsu ..... 160/168.1 R
6,397,918 B1 * 6/2002 Chu ..... 160/167 R
6,619,365 B1 * 9/2003 Wen et al. ..... 160/168.1 P
6,619,366 B2 * 9/2003 Ciuca ..... 160/176.1 R
6,789,597 B2 * 9/2004 Wen et al. ..... 160/168.1 P
6,789,598 B2 * 9/2004 Nien ..... 160/172 R
6,802,356 B2 * 10/2004 Lin ..... 160/168.1 R
6,817,401 B2 * 11/2004 Sun et al. ..... 160/107
6,918,424 B2 * 7/2005 Lin ..... 160/171
6,976,522 B2 * 12/2005 Strand ..... 160/176.1 R
7,096,918 B2 * 8/2006 Lin ..... 160/171
7,124,802 B2 * 10/2006 Sudano ..... 160/89
7,124,803 B2 * 10/2006 Jin et al. ..... 160/107
7,168,476 B2 * 1/2007 Chen ..... 160/170
7,255,150 B2 * 8/2007 Wu ..... 160/168.1 R
7,281,563 B2 * 10/2007 Wu ..... 160/170
7,320,354 B2 * 1/2008 Cheng ..... 160/170
7,367,377 B2 * 5/2008 Lin ..... 160/173 R
7,406,995 B2 * 8/2008 Huang ..... 160/170
7,424,905 B2 * 9/2008 Lai ..... 160/168.1 R
2005/0056383 A1 * 3/2005 Huang ..... 160/170
2006/0042763 A1 * 3/2006 Le Ru ..... 160/171
2006/0070706 A1 * 4/2006 Lin ..... 160/171
2006/0096719 A1 * 5/2006 Wu ..... 160/170
2006/0162874 A1 * 7/2006 Lin ..... 160/168.1 P
2007/0012407 A1 * 1/2007 Nien et al. ..... 160/170
2007/0084569 A1 * 4/2007 Lin ..... 160/173 R (Continued)

*Primary Examiner*—Blair M. Johnson
(74) *Attorney, Agent, or Firm*—Alan Kamrath; Kamrath & Associates PA

(57) ABSTRACT

An adjustable structure of a curtain for adjusting the angle of curtain blades includes a winding tube disposed in an upper rail. A pulling string is wound around the winding tube for controlling the rise and fall of the curtain and then passes through the curtain blades. One end of the winding tube is disposed with a rubbing wheel for hanging the top end of a suspending string provided for insertion of the curtain blades. Thereby, during the rise and fall of the curtain blades, the suspending string is pulled towards the rotating direction of the winding tube, so that the angle of the curtain blades is adjusted.

12 Claims, 7 Drawing Sheets

U.S. PATENT DOCUMENTS

2007/0169897 A1* 7/2007 Lin ..... 160/171
2007/0227677 A1* 10/2007 Yu et al. ..... 160/170
2008/0073038 A1* 3/2008 Cheng ..... 160/168.1 R
2008/0093035 A1* 4/2008 Hsu et al. ..... 160/176.1 R
2008/0099159 A1* 5/2008 Nien ..... 160/170
2008/0121350 A1* 5/2008 Cheng ..... 160/170
2009/0159219 A1* 6/2009 Wen et al. ..... 160/170

* cited by examiner

ADJUSTING STRUCTURE OF A CURTAIN FOR ADJUSTING THE ANGLE OF CURTAIN BLADE

BACKGROUND OF THE INVENTION

1. Field of the Invention

The present invention relates to an adjustable structure of a curtain for adjusting the angle of curtain blades including a winding tube disposed in an upper rail of a curtain, with a pulling string wound around the winding tube and controlling the rise and fall of the curtain and then passing through the curtain blades. One end of the winding tube is disposed with a rubbing wheel for hanging the top end of a suspending string provided for insertion of the curtain blades. During the rise and fall of the curtain blades, the suspending string is pulled to be skewed towards the rotating direction of the winding tube, so that the angle of the curtain blades is adjusted.

2. Description of the Prior Art

Most conventional curtains are used to shield the sunlight. In addition to a structure of controlling the rise and fall of the curtain, the curtain must have a function of adjusting the angle of the curtain blades, so as to adjust the indoor sunlight.

Therefore, the conventional curtain mainly includes two structures: one structure is to control the rise and fall of the curtain, and the other structure is to adjust the angle of the curtain blades. After the curtain blades are adjusted to a suitable position, the angle of the blades can be controlled by the control structure. Thus, the density of the sunlight projected into the room can be adjusted, attaining the purposes of shielding and lighting. However, since those two structures are designed and produced separately, the conventional curtain is difficult to assemble and is of high cost.

The present invention has arisen to mitigate and/or obviate the afore-described disadvantages.

SUMMARY OF THE INVENTION

The primary objective of the present invention is to provide an adjustable structure of a curtain for adjusting the angle of curtain blades including a winding tube disposed in an upper rail of a curtain, with a pulling string wound around the winding tube for controlling the rise and fall of the curtain and then passing through the curtain blades. One end of the winding tube is disposed with a rubbing wheel for hanging the top end of a suspending string provided for insertion of the curtain blades. Thereby, the suspending string will be affected by the rubbing wheel. To summarize, the present invention has the following functions:

Firstly, since the top end of the suspending string is hung on the winding tube provided for winding the pulling string, when the pulling string is released or pulled, the winding tube will be rotated. During the rotation of the winding tube, the angle of the suspending string is changed (when the blades rise and fall slightly, the angles between the blades are changed, and there will appear a dead point after being brought into contact with each other). Thus, the curtain blades will be maintained in a skewed position during the rise and fall of the curtain. After the curtain blades are adjusted to a predetermined position, the user slightly reverses the curtain blades until the angle of the blades meets the needs of the user.

Secondly, the winding tube and the rubbing wheel are disposed in the upper rail, resulting in a curtain which is easy to operate, has a low cost, and has a nice appearance.

The present invention will become more obvious from the following description when taken in connection with the accompanying drawings, which show, for purpose of illustration only, the preferred embodiments in accordance with the present invention.

DETAILED DESCRIPTION OF THE PREFERRED EMBODIMENTS

Figure 1:
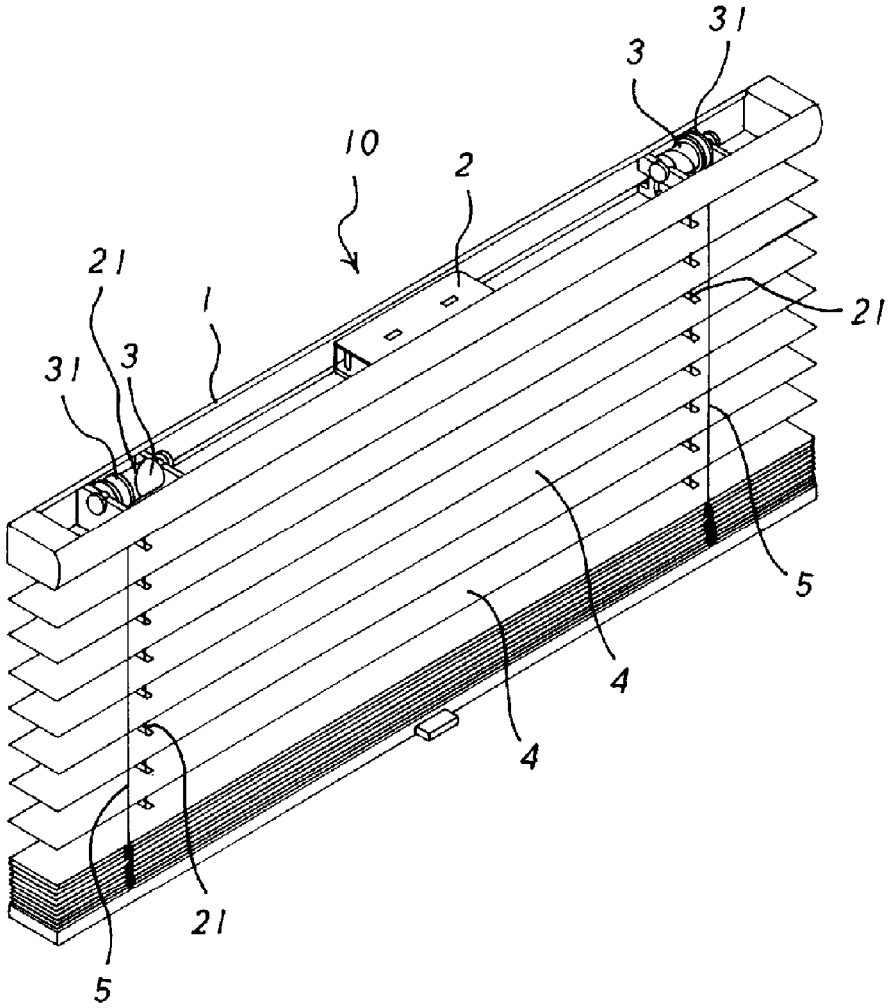
FIG. 1 is a perspective view of an adjustable structure of a curtain for adjusting the angle of curtain blades in accordance with the present invention.
Figure 2:
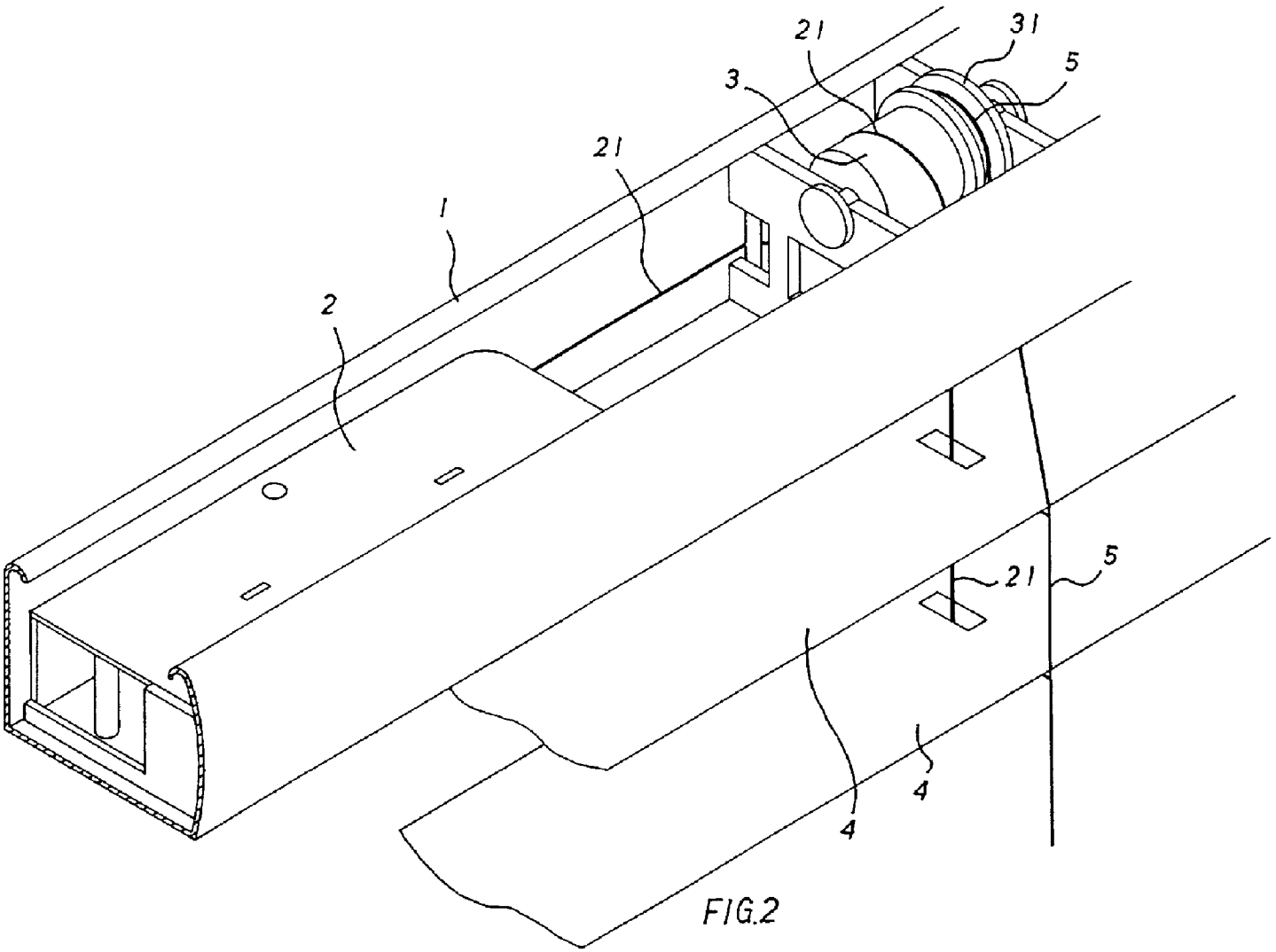
FIG. 2 is a structural view of a roller in accordance with the present invention.

An adjustable structure of a curtain for adjusting the angle of curtain blades in accordance with the present invention comprises a winding tube 3 disposed in an upper rail 1 of a curtain 10. A pulling string 21 is wound around the winding tube 3 for controlling the rise and fall of the curtain and then passes through the curtain blades 4 (as shown in FIGS. 1 and 2). One end of the winding tube 3 is disposed with a rubbing wheel 31 for hanging the top end of a suspending string 5 provided for insertion of the curtain blades 4. Thereby, during the rise and fall of the curtain blades 4, the suspending string 5 is pulled towards the rotating direction of the winding tube 3, so that the angle of the curtain blades 4 is adjusted.

Figure 3:
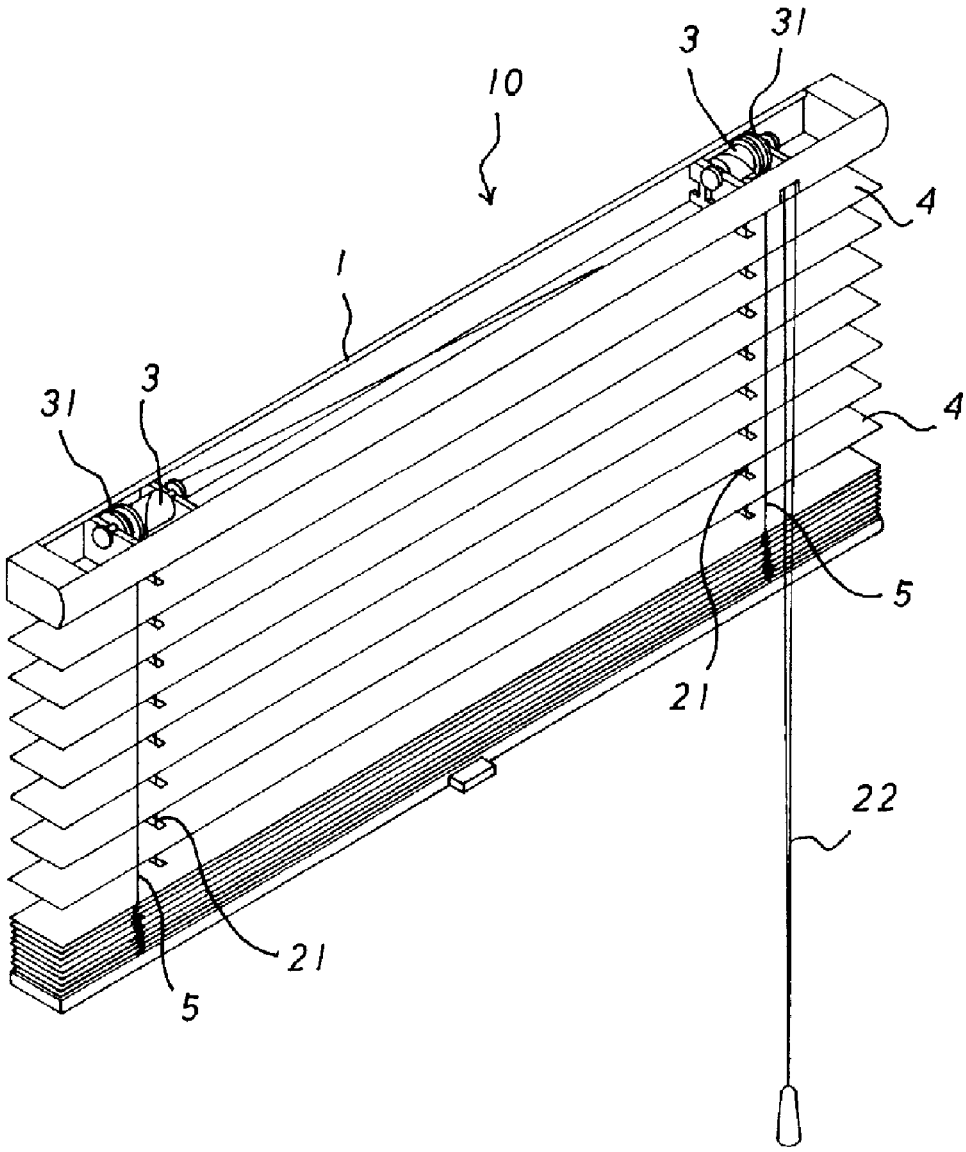
FIG. 3 is another perspective view of the adjustable structure of a curtain for adjusting the angle of curtain blades in accordance with the present invention.
Figure 4:
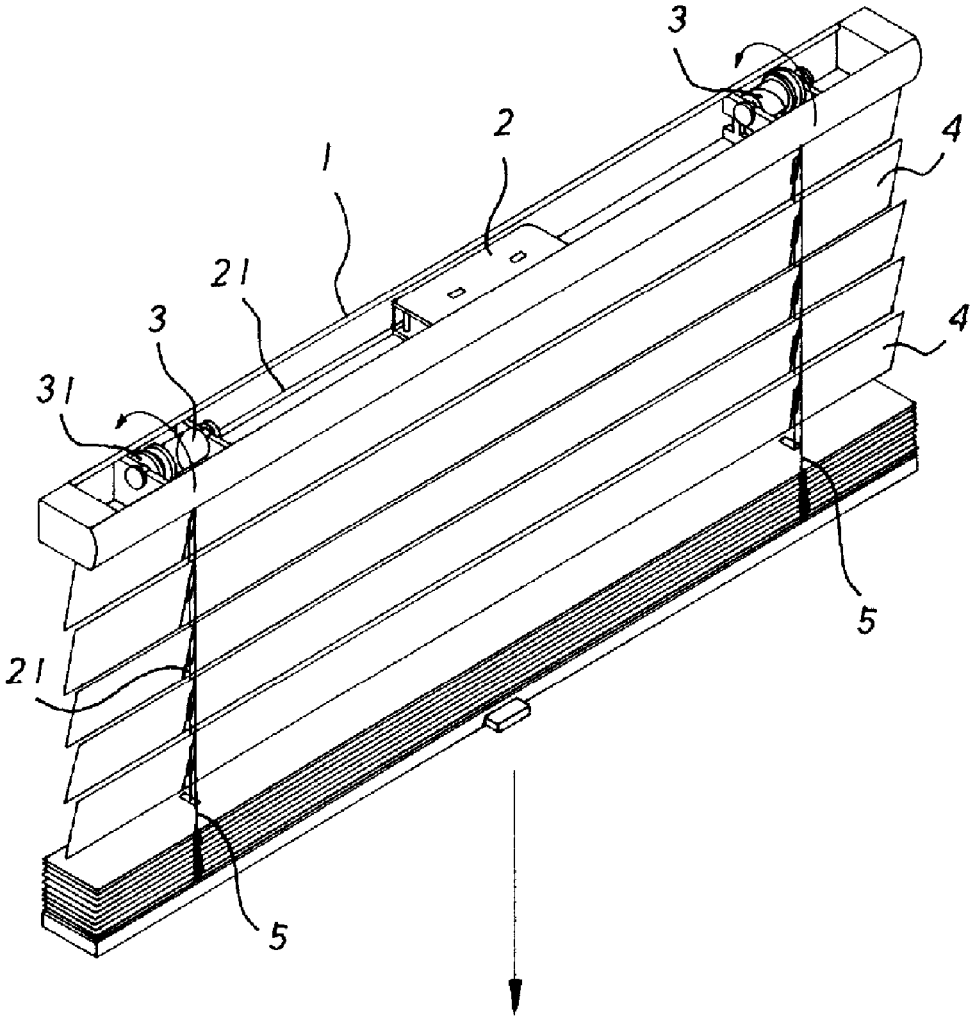
FIG. 4 is an operational view of the adjustable structure of a curtain for adjusting the angle of curtain blades in accordance with the present invention.
Figure 5:
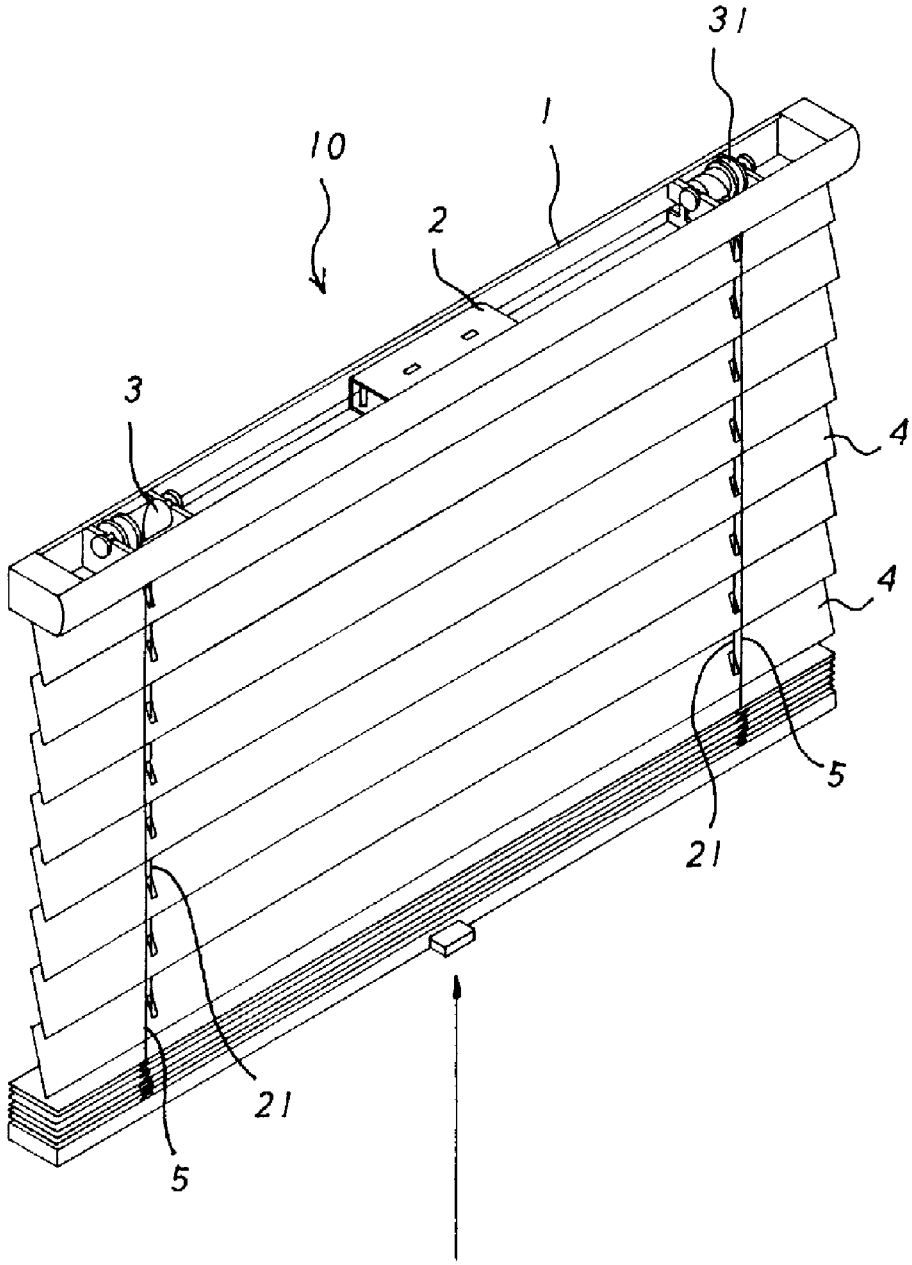
FIG. 5 is another operational view of the adjustable structure of a curtain for adjusting the angle of curtain blades in accordance with the present invention.
Figure 6:
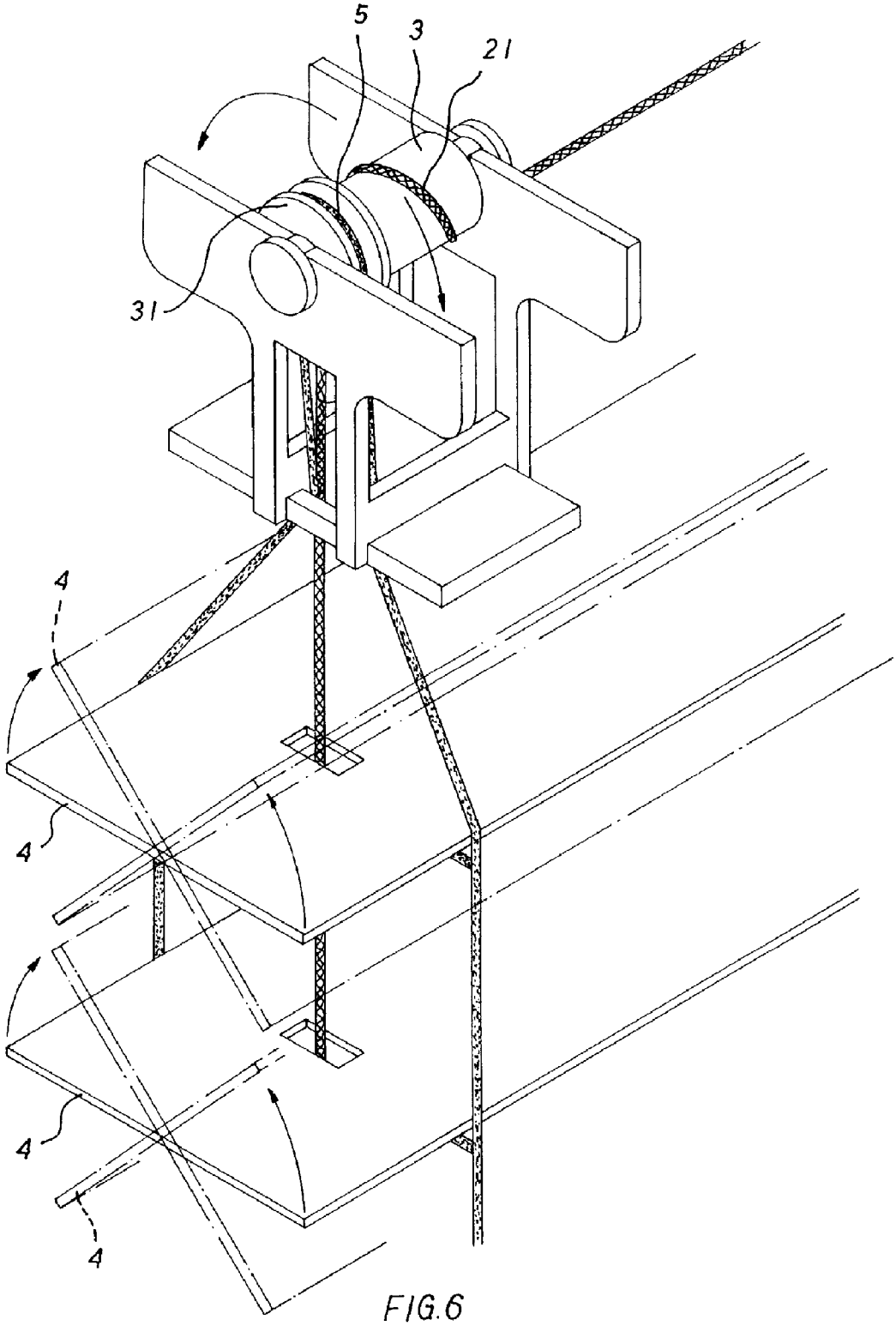
FIG. 6 is a further perspective view showing the rotation of the curtain blades.
Figure 7:
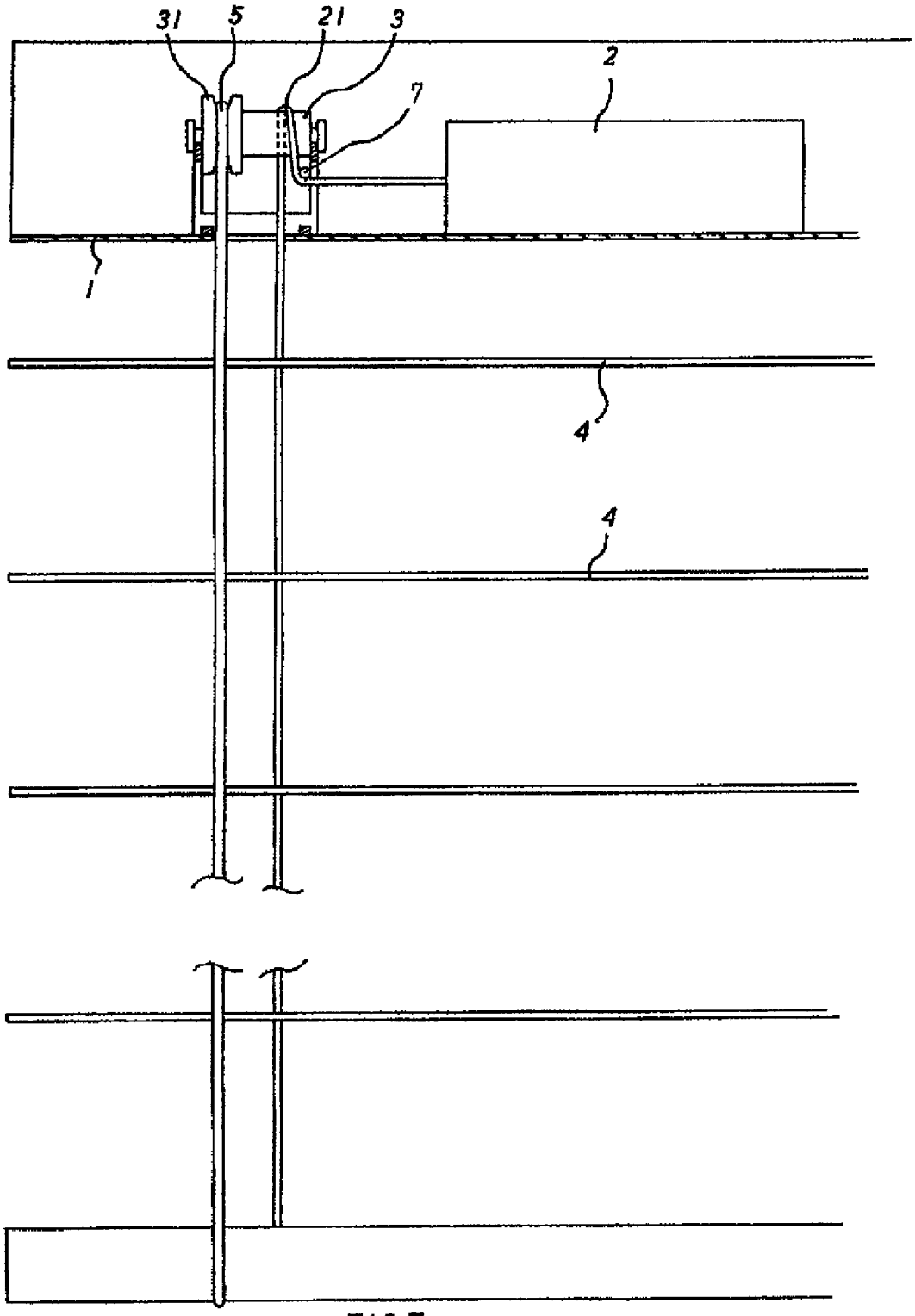
FIG. 7 is a cross sectional view of the adjustable structure of a curtain for adjusting the angle of curtain blades in accordance with the present invention.

Since the winding tube 3 serves as a guiding wheel when the pulling string 21 pulls the curtain blades 4, the winding tube 3 will be rotated by pulling the pulling string 21. The position of the pulling string 21 is controlled by a winder 2 as shown in FIGS. 1, 2, 4, 5 and 7 or by a manual string 22 as shown in FIG. 3. As shown in FIG. 7, the pulling string 21 extending from the winder 2 is directed by a guide 7 generally tangentially onto the winding tube 3 which rotates about the same axis as the rubbing wheel 31. Since one end of the winding tube 3 is disposed with the rubbing wheel 31 (the rubbing wheel 31 rotates along with the winding tube 3), the suspending string 5 hung on the rubbing wheel 31 will also be rotated along with the winding tube 3. However, there will appear a dead point after the angle of the curtain blades 4 connected beneath the suspending string 5 is adjusted to such an extent that the curtain blades 4 are brought into contact with each other (as shown in FIGS. 4 and 5). Thus, the curtain blades 4 will be maintained in a skewed position during the rise and fall of the curtain. After the curtain blades 4 are adjusted to a predetermined position, the user slightly reverses the curtain blades 4. Since the rotating direction of the rubbing wheel 31 is changed according to that of the winding tube 3, the rotation angle of the suspending string 5 is adjusted by the rubbing wheel 31 (as shown in FIGS. 6 and 7, if the curtain blades 4 are skewed outward at the beginning, the curtain blades 4 can be rotated to the horizontal position and finally adjusted to an inwardly-skewed position). Thus, the angle of the curtain blades 4 can be controlled easily. By such arrangement, the rise and fall motion and the angle-adjustment of the curtain blades 4 can be achieved simultaneously. Therefore, the curtain 10 is easy to operate, has a low cost, and has a nice appearance.

Since the rubbing wheel 31 rotates along with the winding tube 3 and is not limited to being coaxial with the winding tube 3, the size of the winding tube 3 and the rubbing wheel 31 can be different (in the present invention, the rubbing wheel 31 is a little bigger than the winding tube 3, thus obtaining greater friction between the suspending string 5 and the rubbing wheel 31). In addition, the direction of the rubbing wheel 31 can be reversed to that of the winding tube 3 (for example, the winding tube 3 and the rubbing wheel 31 are connected by a gear).

While various embodiments in accordance with the present invention have been shown and described, it should be clear to those skilled in the art that further embodiments may be made without departing from the scope of the present invention.

What is claimed is:

1. An adjustable structure of a curtain, comprising:

a winding tube rotatably disposed in an upper rail of a curtain having curtain blades;

a rubbing wheel rotatable with the winding tube;

a pulling string controlling the rise and fall of the curtain, with the pulling string having a first end and a second end, with the pulling string being wound around the winding tube such that the winding tube is intermediate the first and second ends of the pulling string, with the first and second ends of the pulling string being spaced from the winding tube, with a portion of the pulling string which is intermediate the winding tube and the second end being passed through the curtain blades, with the second end of the pulling string having different spacing from the winding tube when the pulling string is wound on the winding tube;

a guide abutting the pulling string spaced from and intermediate the winding tube and the first end of the pulling string, with the pulling string being directed by the guide generally tangentially onto the winding tube; and a suspending string for insertion of the curtain blades, with the suspending string having a top end hung on the rubbing wheel, thereby during the rise and fall of the curtain blades, the suspending string is capable of being actuated in the rotating direction of the winding tube, allowing for adjustment of the angle of the curtain blades, with the first end of the pulling string being pulled to rotate the winding tube to control the rise and fall of the curtain and to rotate the rubbing wheel.

2. The adjustable structure of a curtain as claimed in claim 1, further comprising: a winder located in the upper rail, with the winding tube being rotatable independent of the winder, with the first end of the pulling string being connected to and pulled by the winder.

3. The adjustable structure of a curtain as claimed in claim 1, wherein the first end of the pulling string is a manual string.

4. The adjustable structure of a curtain as claimed in claim 1, wherein the rubbing wheel and the winding tube are disposed in the upper rail in a same axis.

5. The adjustable structure of a curtain as claimed in claim 1, wherein the winding tube and the rubbing wheel have a same rotating path.

6. The adjustable structure of a curtain as claimed in claim 1, wherein the winding tube and the rubbing wheel are rotated in a same direction.

7. The adjustable structure of a curtain as claimed in claim 2, wherein the rubbing wheel and the winding tube are disposed in the upper rail in a same axis.

8. The adjustable structure of a curtain as claimed in claim 3, wherein the rubbing wheel and the winding tube are disposed in the upper rail in a same axis.

9. The adjustable structure of a curtain as claimed in claim 2, wherein the winding tube and the rubbing wheel have a same rotating path.

10. The adjustable structure of a curtain as claimed in claim 3, wherein the winding tube and the rubbing wheel have a same rotating path.

11. The adjustable structure of a curtain as claimed in claim 2, wherein the winding tube and the rubbing wheel are rotated in a same direction.

12. The adjustable structure of a curtain as claimed in claim 3, wherein the winding tube and the rubbing wheel are rotated in a same direction.

* * * * *